US008854266B2

(12) United States Patent
Zhu et al.

(10) Patent No.: US 8,854,266 B2
(45) Date of Patent: Oct. 7, 2014

(54) ANTENNA ISOLATION ELEMENTS

(75) Inventors: Jiang Zhu, Sunnyvale, CA (US); Jerzy Guterman, Mountain View, CA (US); Mattia Pascolini, San Mateo, CA (US); Jayesh Nath, Santa Clara, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 459 days.

(21) Appl. No.: 13/216,012

(22) Filed: Aug. 23, 2011

(65) Prior Publication Data

US 2013/0050031 A1 Feb. 28, 2013

(51) Int. Cl.
*H01Q 1/24* (2006.01)
*H01Q 7/00* (2006.01)
*H01Q 1/52* (2006.01)

(52) U.S. Cl.
CPC ..... *H01Q 1/523* (2013.01)
USPC ..... 343/702; 343/866; 343/867

(58) Field of Classification Search
USPC ..... 343/702, 742, 866, 867
See application file for complete search history.

(56) References Cited

U.S. PATENT DOCUMENTS

| | | | | |
|---|---|---|---|---|
| 3,490,025 | A | 1/1970 | Pickles | |
| 4,814,776 | A | 3/1989 | Caci et al. | |
| 6,429,818 | B1 | 8/2002 | Johnson et al. | |
| 6,784,843 | B2 | 8/2004 | Onaka et al. | |
| 7,205,942 | B2 | 4/2007 | Wang et al. | |
| 7,701,395 | B2 | 4/2010 | Alvey et al. | |
| 7,773,033 | B2 * | 8/2010 | Morton et al. | 342/198 |
| 7,830,320 | B2 | 11/2010 | Shamblin et al. | |
| 7,973,722 | B1 | 7/2011 | Hill et al. | |
| 7,982,616 | B2 | 7/2011 | Banerjee et al. | |
| 8,482,471 | B2 * | 7/2013 | Su | 343/742 |
| 8,493,183 | B2 * | 7/2013 | Yamagajp et al. | 340/10.1 |
| 2003/0193437 | A1 | 10/2003 | Kangasvieri et al. | |

(Continued)

FOREIGN PATENT DOCUMENTS

| | | | |
|---|---|---|---|
| CA | 2296458 | A1 | 5/2001 |
| CA | 201878257 | U | 6/2011 |

(Continued)

OTHER PUBLICATIONS

Kamal Sarabandi et al., "Subwavelength Radio Repeater System Utilitizing Miniaturized Antennas and Metamaterial Channel Isolator", IEEE Transactions on Antennas and Propagation, IEEE Service Center, Piscataway, NJ, US, vol. 59, No. 7, Jul. 1, 2011 (pp. 2683-2690), XP011369390.

(Continued)

*Primary Examiner* — Tan Ho
(74) *Attorney, Agent, or Firm* — Treyz Law Group; David C. Kellogg; G. Victor Treyz

(57) ABSTRACT

Electronic devices may be provided with antenna structures and antenna isolation element structures. An antenna array may be located within an electronic device. The antenna array may have multiple antennas and interposed antenna isolation element structures for isolating the antennas from each other. An antenna isolation element structure may have a dielectric carrier with a longitudinal axis. A sheet of conductive material may extend around the longitudinal axis to form a conductive loop structure. The loop structure in the antenna isolation element may have a gap that spans the sheet of conductive material parallel to the longitudinal axis. Electronic components may bridge the gap. Control circuitry may adjust the electronic components to tune the antenna isolation element.

16 Claims, 15 Drawing Sheets

(56) References Cited

U.S. PATENT DOCUMENTS

| | | | |
|---|---|---|---|
| 2009/0009414 | A1 | 1/2009 | Reykowski |
| 2009/0091507 | A1 | 4/2009 | Chung et al. |
| 2010/0072287 | A1 | 3/2010 | Kai et al. |
| 2010/0079217 | A1 | 4/2010 | Morton et al. |
| 2010/0156741 | A1 | 6/2010 | Vazquez et al. |
| 2010/0238072 | A1 | 9/2010 | Ayatollahi et al. |
| 2010/0321249 | A1 | 12/2010 | Chiang et al. |
| 2011/0078749 | A1 | 3/2011 | Wieck et al. |
| 2011/0148736 | A1 | 6/2011 | Choi et al. |
| 2011/0241953 | A1 | 10/2011 | Su |
| 2012/0086619 | A1 | 4/2012 | Nakamura et al. |
| 2012/0193997 | A1 | 8/2012 | Hong et al. |

FOREIGN PATENT DOCUMENTS

| | | | |
|---|---|---|---|
| CN | 101561699 | A | 10/2009 |
| CN | 201655979 | U | 11/2010 |
| CN | 102257673 | A | 11/2011 |
| DE | 102007026965 | | 1/2009 |
| EP | 1649546 | | 4/2006 |
| EP | 2083472 | | 7/2009 |
| TW | 200917571 | A | 4/2009 |
| TW | 201029262 | A | 8/2010 |
| WO | 02065583 | A2 | 8/2002 |
| WO | 2011005012 | A1 | 1/2011 |
| WO | 2011076582 | | 6/2011 |

OTHER PUBLICATIONS

Zhu et al., U.S. Appl. No. 13/216,073, filed Aug. 23, 2011.

Zhu et al., U.S. Appl. No. 13/299,123, filed Nov. 17, 2011.

* cited by examiner

ANTENNA ISOLATION ELEMENTS

BACKGROUND

This relates generally to electronic devices and, more particularly, to electronic devices with antennas.

Electronic devices such as computers are often provided with antennas. For example, a computer monitor with an integrated computer may be provided with antennas that are located along an edge of the monitor.

Challenges can arise in mounting antennas within an electronic device, particularly in applications in which it is desired to form an array of multiple antennas. For example, the relative position between antennas in an array can affect coupling between antennas. If care is not taken, antennas may not be sufficiently well isolated from one another, which may degrade wireless performance.

It would therefore be desirable to be able to provide improved arrangements for isolating antennas in electronic devices.

SUMMARY

An electronic device may be provided with an array of multiple antennas. To isolate the antennas from each other, one or more antenna isolation elements may be provided. The antenna isolation elements may be interposed in the array between respective pairs of antennas.

The antennas in an antenna array may be, for example, distributed loop antennas. The antenna isolation elements may be based on loop-shaped parasitic structures.

An antenna isolation element may have a dielectric carrier with a longitudinal axis. A sheet of conductive material may extend around the longitudinal axis to form a conductive loop structure. The loop structure in the antenna isolation element may have a gap that spans the sheet of conductive material parallel to the longitudinal axis. Electronic components may bridge the gap. Control circuitry may adjust the electronic components to tune the antenna isolation element.

Further features of the invention, its nature and various advantages will be more apparent from the accompanying drawings and the following detailed description of the preferred embodiments.

DETAILED DESCRIPTION

Electronic devices may be provided with antennas and other wireless communications circuitry. The wireless communications circuitry may be used to support wireless communications in multiple wireless communications bands. One or more antennas may be provided in an electronic device. For example, antennas may be used to form an antenna array to support communications with a communications protocol such as the IEEE 802.11(n) protocol that uses multiple antennas.

Figure 1:
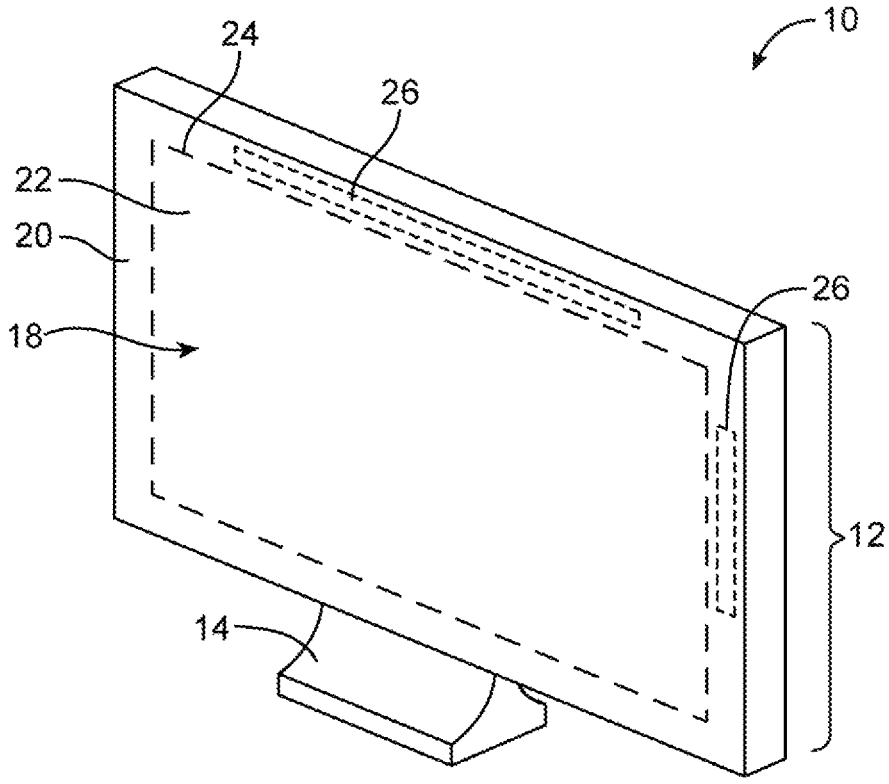
FIG. 1 is a perspective view of an illustrative electronic device with antennas and antenna isolation structures in accordance with an embodiment of the present invention.

An illustrative electronic device of the type that may be provided with one or more antennas is shown in FIG. 1. Electronic device 10 may be a computer such as a computer that is integrated into a display such as a computer monitor. Electronic device 10 may also be a laptop computer, a tablet computer, a somewhat smaller portable device such as a wrist-watch device, pendant device, headphone device, earpiece device, or other wearable or miniature device, a cellular telephone, a media player, or other electronic equipment. Illustrative configurations in which electronic device 10 is a computer formed from a computer monitor are sometimes described herein as an example. In general, electronic device 10 may be any suitable electronic equipment.

Device 10 may include one or more antenna isolation elements. The antenna isolation elements, which are sometimes referred to as parasitic elements, may be used to reduce coupling between antennas. For example, an isolation element may be placed between a pair of antennas in device 10 to help isolate the antennas from each other. Enhancing antenna isolation may help to improve the performance of wireless circuits such as 802.11(n) circuits during operation. The isolation elements may be formed from loop-based structures (e.g., distributed loop-based structures) or other parasitic antenna element structures.

Antennas and antenna isolation elements may be formed in device 10 in any suitable location such as locations along the edge of device 10. For example, antennas and antenna isolation elements may be formed in one or more locations such as locations 26 in device 10. The antennas in device 10 may include loop antennas, inverted-F antennas, strip antennas, planar inverted-F antennas, slot antennas, cavity antennas, monopoles, dipoles, patch antennas, hybrid antennas that include antenna structures of more than one type, or other suitable antennas. Antenna isolation elements may also be formed using structures such as these. The antennas may cover cellular network communications bands, wireless local area network communications bands (e.g., the 2.4 and 5 GHz bands associated with protocols such as the Bluetooth® and IEEE 802.11 protocols), and other communications bands. The antennas may support single band and/or multiband operation. For example, the antennas may be dual band antennas that cover the 2.4 and 5 GHz bands. The antennas may also cover more than two bands (e.g., by covering three or more bands or by covering four or more bands). Antenna isolation elements may operate to isolate antenna in one or more bands, two or more bands (e.g., 2.4 and/or 5 GHz bands), three or more bands, etc.

Conductive structures for the antennas and antenna isolation elements may, if desired, be formed from conductive electronic device structures such as conductive housing structures, from conductive structures such as metal traces on plastic carriers, from metal traces in flexible printed circuits and rigid printed circuits, from metal foil supported by dielectric carrier structures, from wires, and from other conductive materials.

Device 10 may include a display such as display 18. Display 18 may be mounted in a housing such as electronic device housing 12. Housing 12 may be supported using a stand such as stand 14 or other support structure.

Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Display 18 may be a touch screen that incorporates capacitive touch electrodes or other touch sensor components or may be a display that is not touch sensitive. Display 18 may include image pixels formed from light-emitting diodes (LEDs), organic LEDs (OLEDs), plasma cells, electronic ink elements, liquid crystal display (LCD) components, or other suitable image pixel structures.

A cover glass layer may cover the surface of display 18. Rectangular active region 22 of display 18 may lie within rectangular boundary 24. Active region 22 may contain an array of image pixels that display images for a user. Active region 22 may be surrounded by an inactive peripheral region such as rectangular ring-shaped inactive region 20. The inactive portions of display 18 such as inactive region 20 are devoid of active image pixels. Display driver circuits, antennas and antenna isolation elements (e.g., antennas and antenna isolation elements in regions such as regions 26), and other components that do not generate images may be located under inactive region 20.

The cover glass for display 18 may cover both active region 22 and inactive region 20. The inner surface of the cover glass in inactive region 20 may be coated with a layer of an opaque masking material such as opaque plastic (e.g., a dark polyester film) or black ink. The opaque masking layer may help hide internal components in device 10 such as antennas, driver circuits, housing structures, mounting structures, and other structures from view.

The cover layer for display 18, which is sometimes referred to as a cover glass, may be formed from a dielectric such as glass or plastic. Antennas and antenna isolation elements may be mounted in regions such as regions 26 under an inactive portion of the cover glass. The antennas may transmit and receive signals through the cover glass. This allows the antennas to operate, even when some or all of the structures in housing 12 are formed from conductive materials. For example, mounting the antenna structures of device 10 under part of inactive region 20 may allow the antennas to operate even in arrangements in which some or all of the walls of housing 12 are formed from a metal such as aluminum or stainless steel (as examples).

Figure 2:
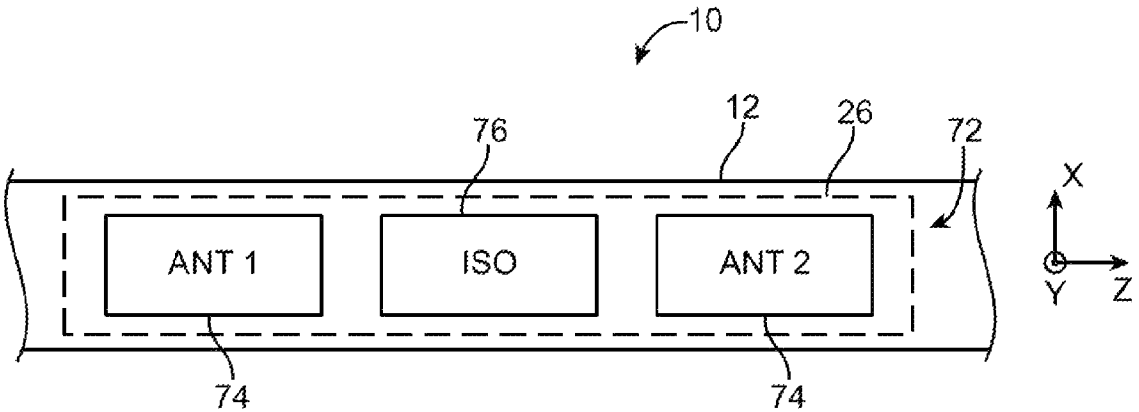
FIG. 2 is a top view of a portion of an illustrative electronic device containing a pair of antennas and an antenna isolation element in accordance with an embodiment of the present invention.

A top (front) view of a portion of device 10 in the vicinity of an array of antennas mounted under region 26 of a display cover glass is shown in FIG. 2. As shown in FIG. 2, antenna array 72 may include antennas 74 and antenna isolation element 76. In the arrangement shown in FIG. 2, antenna isolation element 76 is interposed between a first of antennas 74 (antenna ANT1) and a second of antennas 74 (antenna ANT2). If desired, antenna isolation elements (i.e., parasitic elements) may be located in other locations within device 10 (e.g., in a location that is not interposed between antennas 74 such as to the left of antenna ANT1 or to the right of antenna ANT2 or elsewhere in device 10). The configuration of FIG. 2 is merely illustrative.

Figure 3:
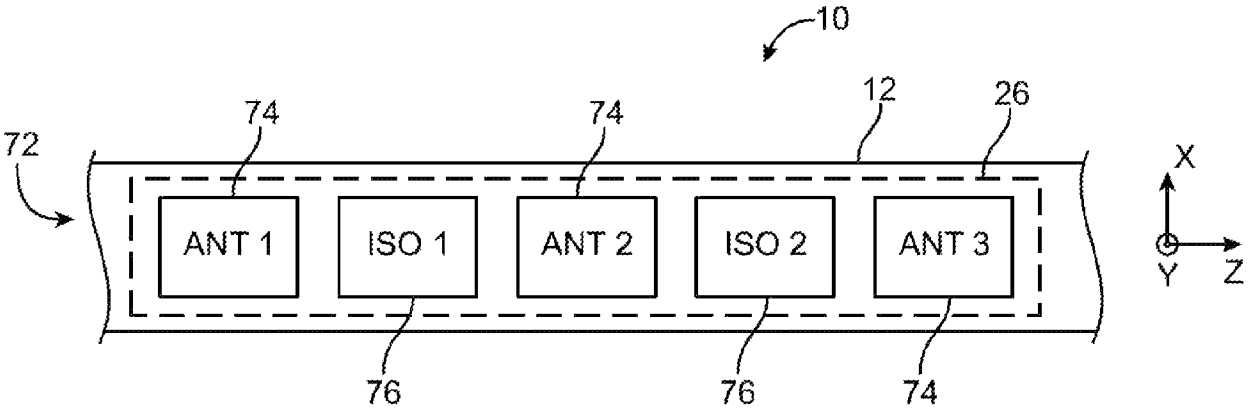
FIG. 3 is a top view of a portion of an illustrative electronic device containing an array of three antennas with two interposed antenna isolation elements in accordance with an embodiment of the present invention.

If desired, device 10 may include multiple antenna isolation elements. As shown in FIG. 3, for example, antenna array 72 may include three antennas 74 and two antenna isolation elements 76. Antenna isolation element ISO1 may be interposed between antennas ANT1 and ANT2 and antenna isolation element ISO2 may be interposed between antennas ANT2 and ANT3 (as an example). Antenna arrays with more than three antennas and two or more antenna isolation elements may also be used in device 10.

Figure 4:
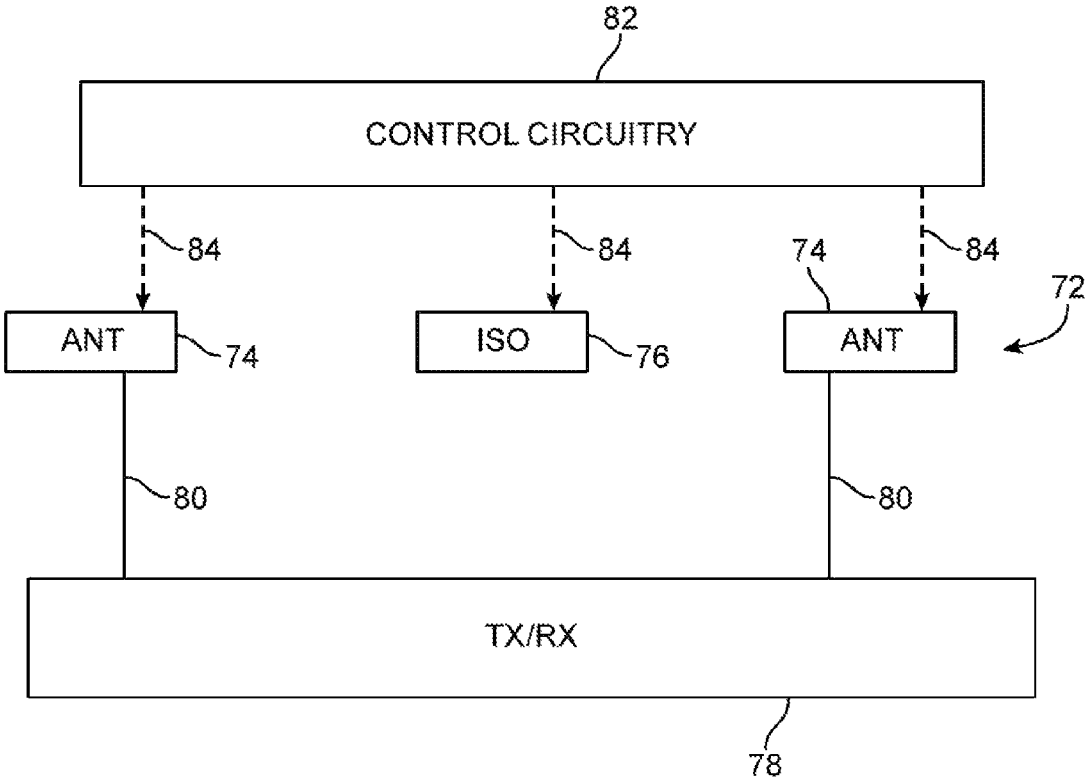
FIG. 4 is a diagram showing how antennas may be coupled to radio-frequency transceiver circuitry and how optional control circuitry may be used in controlling antennas and isolation element structures in accordance with an embodiment of the present invention.

FIG. 4 is a circuit diagram showing how radio-frequency transceiver circuitry such as transceiver circuitry 78 may be coupled to antennas 74 in antenna array 72. Respective transmission lines 80 may be used in coupling transceiver circuitry 78 to each antenna 74. Transmission lines 80 may each include one or more portions of transmission line structures such as coaxial cable transmission lines, microstrip transmission lines, stripline transmission lines, edge coupled microstrip transmission lines, edge coupled stripline transmission lines, or other suitable transmission lines. Each transmission line 80 may include one or more portions of different types of transmission line structures (e.g., a segment of coaxial cable, a segment of a microstrip transmission line formed on a printed circuit board, etc.). Transmission lines 80 may each may contain a positive conductor (+) and a ground conductor (−). The conductors in transmission lines 80 may be formed from wires, braided wires, strips of metal, conductive traces on substrates, planar metal structures, housing structures, or other conductive structures.

Antennas 74 and isolation elements 76 may, if desired, contain tunable components such as tunable capacitors and other tunable circuitry. The tunable circuitry in antennas 74 and isolation elements 76 may be used to adjust the performance of antenna array 72 to cover various communications bands of interest during operation of device 10. As shown in FIG. 4, control circuitry 82 may supply control signals to the antennas and antenna isolation elements of antenna array 72 using communications paths such as paths 84. Control circuitry 82 may include baseband processor integrated circuits, microprocessors, microcontrollers, memory, application specific integrated circuits, and other storage and processing circuitry for device 10. Paths 84 may serve as control paths that convey control signals from control circuitry 82 to adjustable circuits in antennas 74 and/or isolation elements 76.

Figure 5:
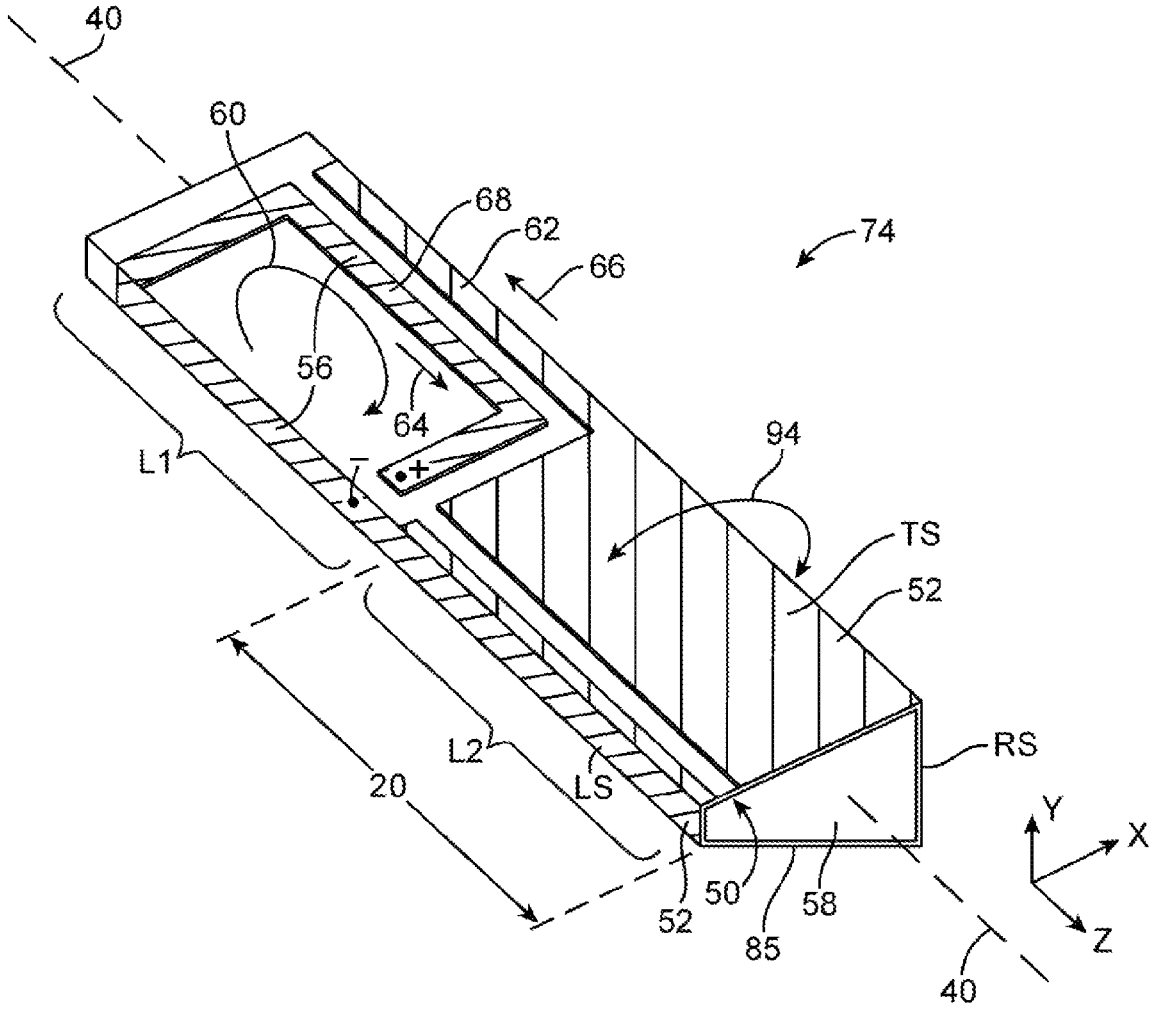
FIG. 5 is a perspective view of an illustrative loop antenna of the type that may be used in an antenna array in accordance with an embodiment of the present invention.

An illustrative antenna of the type that may be used to implement antennas in antenna array 72 in device 10 is shown in FIG. 5. As shown in FIG. 5, antenna 74 may have two loop-based portions (L1 and L2). In particular, antenna 74 may have a first portion formed from antenna resonating element structure L2 and a second portion formed from antenna feed structure L1. In structure L2, current may loop within conductive material 52 in directions 94 about axis 40. In structure L1, current 60 may loop within conductive structures 56.

Feed structure L1 may be a loop antenna structure that is directly fed by transmission line 80 at a positive antenna feed terminal (+) and ground antenna feed terminal (−). Antenna resonating element structure L2 may be a loop antenna structure having conductive material 52 that extends around longitudinal axis 40 of structure L2 and that is distributed across dimension ZD of structure L2 (i.e., a sheet of conductive material that is distributed along longitudinal axis 40). Antenna feed structure L1 may be formed from conductive structures 56.

Conductive structures 52 and 56 may be formed from metal, conductive materials that contain metal, or other conductive substances. One or more support structures such as support structures 58 may be used to support conductive structures 52 and 56 of antenna structures L1 and L2 in antenna 74. Support structures 58 may be formed from a dielectric such as plastic. Conductive structures 52 and 56 may be, for example, metal traces formed on a plastic carrier or metal traces formed on a flex circuit substrate or other substrate that is attached to support structures 58 (as examples).

In the illustrative configuration for antenna 74 that is shown in FIG. 5, support structures 58 have parallel left and right surfaces LS and RS and have a bottom surface BS that is angled with respect to top surface TS. Directly fed antenna feed structure L1 may be directly fed by a transmission line 80 using an antenna feed formed a positive antenna feed terminal (+) and a ground antenna feed terminal (−). During operation, currents in structure L1 may circulate within structure L1 as indicated by loop 60. The current circulating within structure L1 produces electromagnetic fields that are coupled to structure L2 (i.e., structure L2 is indirectly fed by structure L1).

Indirectly fed antenna resonating element structure L2 may be formed from conductive structures 52 that are looped around longitudinal axis 40 of antenna 74. Gap 50 or other suitable structures or components that are interposed in the loop of structure L2 may be used to create a capacitance within the loop of structure L2 (as an example).

As shown in FIG. 5, some of the conductive structures of antenna structures L1 and L2 may be electrically coupled to each other. For example, some of the metal structures on surfaces LS, RS, and BS (sometimes referred to as ground plane structures) may extend into parts of structure L1 and parts of structure L2.

The coupling between structures L1 and L2 is affected both by electromagnetic near field coupling and by electrical coupling through shared conductive structures. Electromagnetic coupling occurs when electromagnetic fields that are generated by one loop pass through the other loop. Electric coupling occurs when current is generated in a shared conductor such as a portion of a shared ground plane structure. Consider, as an example, current flowing in portion 68 of loop L1 in direction 64. This current may electromagnetically induce a current in direction 66 in structures 62. Because structure 62 is electrically connected to structures 52 (because structure 62 is a longitudinal extension of structures 52), the flow of induced current 66 tends to result in currents in structures 52. The presence of portion 62 in antenna 28 may therefore enhance coupling between antenna structures L1 and L2.

Figure 6:
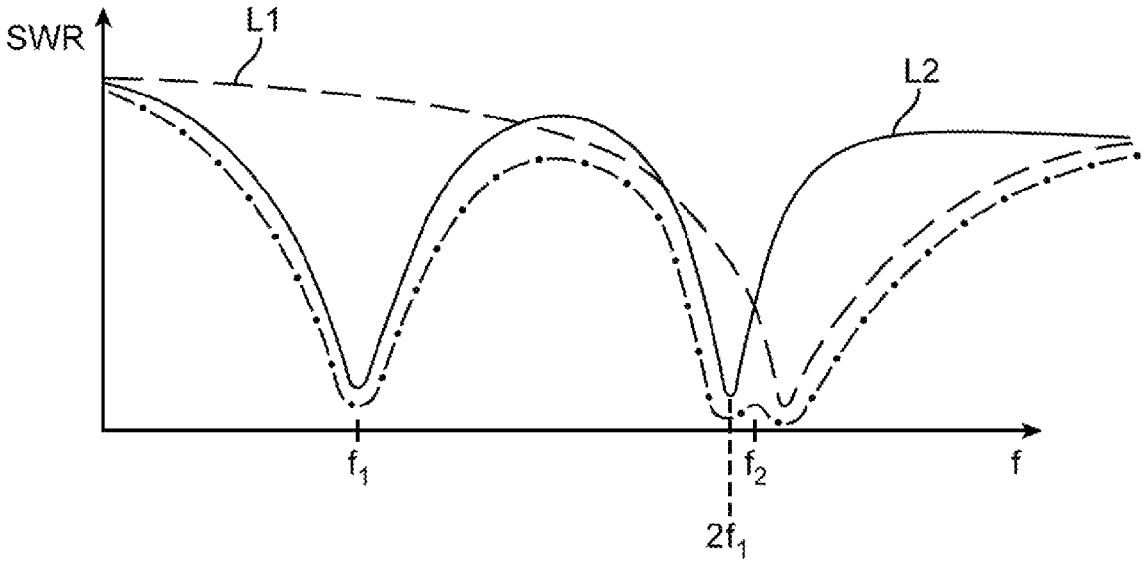
FIG. 6 is a graph of antenna performance for an illustrative indirectly fed distributed loop antenna showing respective contributions to performance that may be made by a loop-shaped indirect feeding structure and a loop antenna resonating element structure in accordance with the present invention.

A graph corresponding to an illustrative antenna 74 in which both structures L1 and L2 contribute to antenna performance (for at least some frequencies of operation) is shown in FIG. 6. In FIG. 6, standing wave ratio (SWR) for a loop antenna that includes both antenna structure L1 and antenna structure L2 (e.g., in an arrangement of the type shown in FIG. 5) is plotted as a function of operating frequency f. Frequency f1 may correspond to the center frequency of a first band of interest such as an IEEE 802.11 band of 2.4 GHz (as an example). Frequency f2 may correspond to the center frequency of a second band of interest such as an IEEE 802.11 band of 5 GHz (as an example). Antennas that cover more than two bands, fewer than two bands, and/or other bands of interest may use a distributed loop configuration. The example of FIG. 6 is merely illustrative.

Curve L2 of FIG. 6 corresponds to the contribution to antenna 74 from antenna resonating element L2. As shown in FIG. 6, there are performance contributions from L2 at frequency f1 and a frequency that is equal to about 2 times f1 (i.e., at 2f1, which is the second harmonic of frequency f1). The antenna performance contribution from antenna structure L2 at the second harmonic of frequency f1 may lie close to upper band center frequency f2.

Curve L1 corresponds to the contribution to antenna 74 from antenna resonating element L1. There may be relatively little contribution to antenna performance from L1 at frequencies in the vicinity of low band frequency f1. However, at frequencies in the vicinity of f2, L1 may exhibit a resonance that broadens the bandwidth of antenna 74 from L2 and helps antenna 28 adequately cover the upper band at f2.

Figure 7:
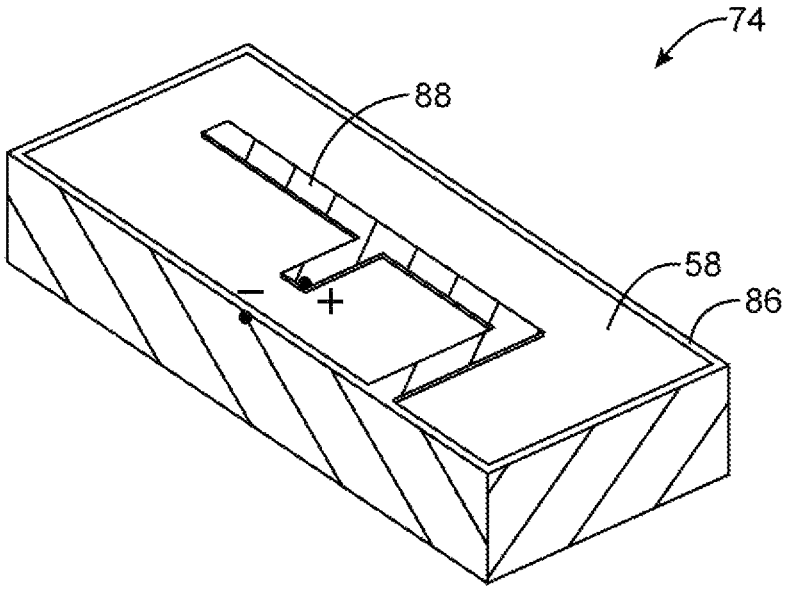
FIG. 7 is a perspective view of an illustrative cavity-backed inverted-F antenna of the type that may be used in an antenna array in accordance with an embodiment of the present invention.

If desired, other types of antenna may be used in implementing antennas 74 in antenna array 72. Examples of other types of antenna that may be used for antennas 74 include inverted-F antennas, strip antennas, planar inverted-F antennas, slot antennas, cavity antennas, patch antennas, monopoles, dipoles, hybrid antennas that include antenna structures of more than one type, or other suitable antennas. FIG. 7 is a perspective view of an illustrative configuration for antenna 74 based on a cavity-backed inverted-F antenna design. As shown in FIG. 7, antenna 74 may have a support structure such as dielectric support structure 58. Metal or other conductive material 86 may be used to cover the bottom and sidewall surfaces of structure 58 and thereby form an antenna cavity for cavity-backed antenna 74. Inverted-F antenna resonating element 88 or other suitable antenna resonating element structures may be mounted in an opening that is formed at the upper surface of the cavity to form antenna 74. The antenna may be fed using an antenna feed formed from a positive antenna feed terminal (terminal +) and a ground antenna feed terminal (terminal –).

Figure 8:
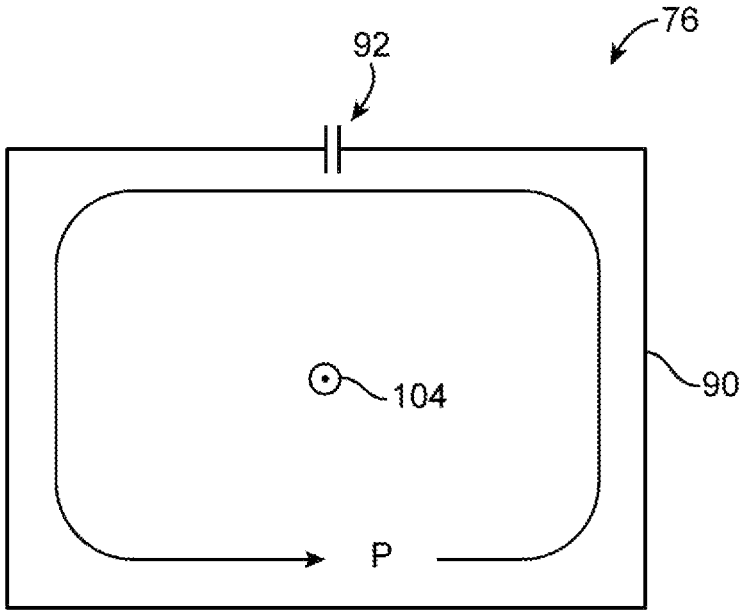
FIG. 8 is a schematic diagram of an illustrative loop-based antenna isolation element in accordance with an embodiment of the present invention.

An illustrative loop-based antenna isolation element (parasitic element) that may be used for antenna isolation element 76 of antenna array 72 is shown in FIG. 8. As shown in FIG. 8, antenna isolation element 76 may have conductive structures that form a loop-shaped conductive path (loop-shaped path 90 encircling axis 104). A gap may be interposed in the conductive materials that form the loop and/or components may be interposed within the loop to introduce capacitance 92. The inclusion of capacitance 92 (e.g., from a gap in conductive structures 90) may help antenna isolation element 76 resonate (and perform isolation functions) at a frequency that is lower than would otherwise be possible. This may allow antenna isolation element 76 to be used in isolating antennas in a desired communications band without requiring the use of excessively large structures 90 (i.e., without enlarging perimeter P of path 90 excessively to create a desired reduction in operating frequency). The resonant frequency for isolation element 76 (i.e., the frequency at which isolation element 76 is effective at isolating antennas 74 from each other) for a loop-based structure of the type shown in FIG. 8 that includes capacitance 92 will tend to decrease as the value of capacitance 92 is increased.

Loop path 90 may be implemented using a wire, using metal traces or other conductive traces on a flexible printed circuit (e.g., a "flex circuit" formed from a flexible sheet of polymer such as a sheet of polyimide), using metal traces on a rigid printed circuit board, using metal foil, using portions of conductive housing structures in housing 12, or using other suitable conductive structures.

Figure 9:
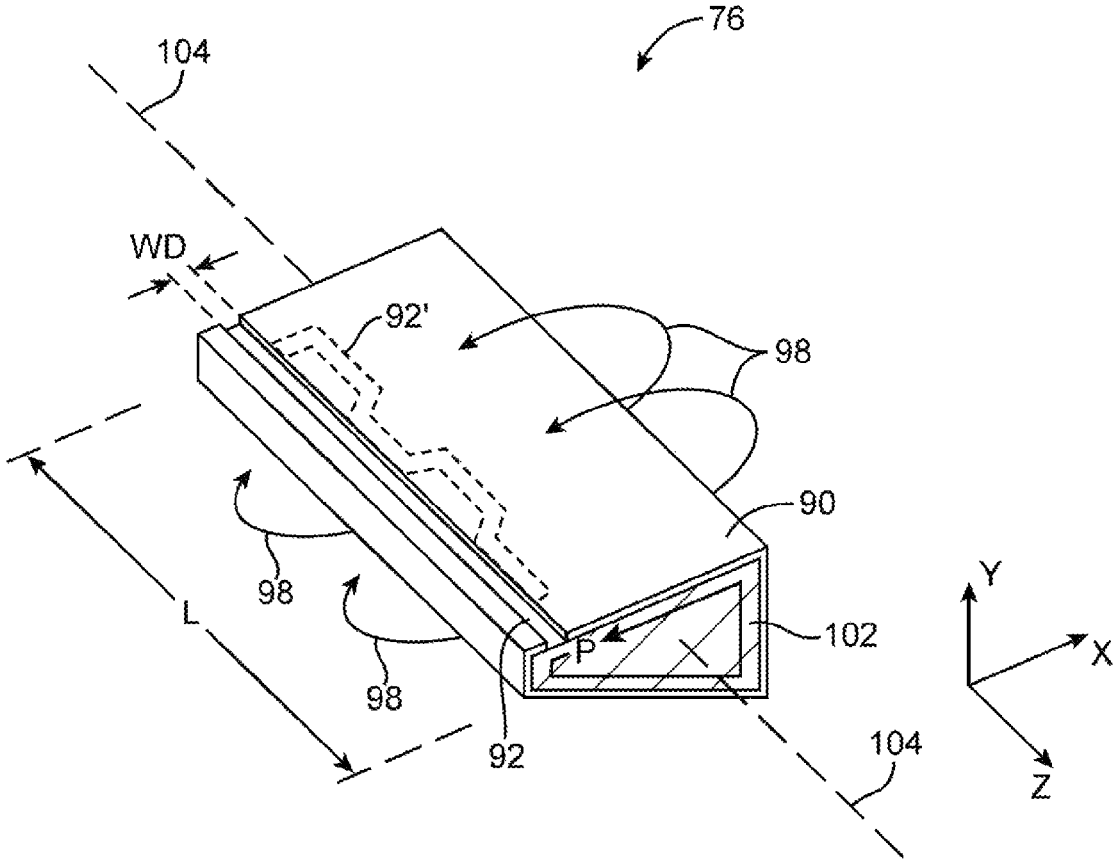
FIG. 9 is a perspective view of an illustrative loop-based antenna isolation element in accordance with an embodiment of the present invention.

An illustrative configuration that may be used for antenna isolation element 76 is shown in FIG. 9. As shown in FIG. 9, antenna isolation element 76 may have conductive structures 90 that form a loop shape. Conductive structures 90 may be formed from a sheet (strip) of conductive material that extends around longitudinal axis 104 of antenna isolation element 76. Conductive structures 90 may be formed on dielectric support structures 102 (e.g., plastic or other suitable material). The dimension L of isolation element 76 along longitudinal axis 104 (i.e., the dimension across the strip of conductor 90 that is wrapped around support structure 102 and axis 104) may be, for example, about 1-5 cm, about 1-10 cm, about 2-10 cm, about 2-5 cm, more than 1 cm, less than 10 cm, or other suitable size. Peripheral dimension P (i.e., the length of the loop of metal 90 or other conductor that is wrapped around support 102) may be about 1.5 to 2.5 cm, about 2.5 cm, 1.5 to 3.5 cm, 1 to 4 cm, more than 1 cm, less than 4 cm, or other suitable size.

Capacitance 92 of loop-based antenna isolation element 76 may be formed from a gap in conductive structures 90 that spans the sheet of material that is looped around axis 104. The gap may, for example, have a width WD. In the FIG. 9 example, the gap in conductive loop structures 90 is formed from a straight split in structures 90 that runs in a lateral dimension across structures 90 parallel to longitudinal axis 104. The gap in structures 90 may have other shapes such as a meandering path shape (e.g., illustrative meandering gap 92' of FIG. 9). Use of a meandering path shape for the gap in conductive structures 90 may help to increase the magnitude of capacitance 92.

Figure 10:
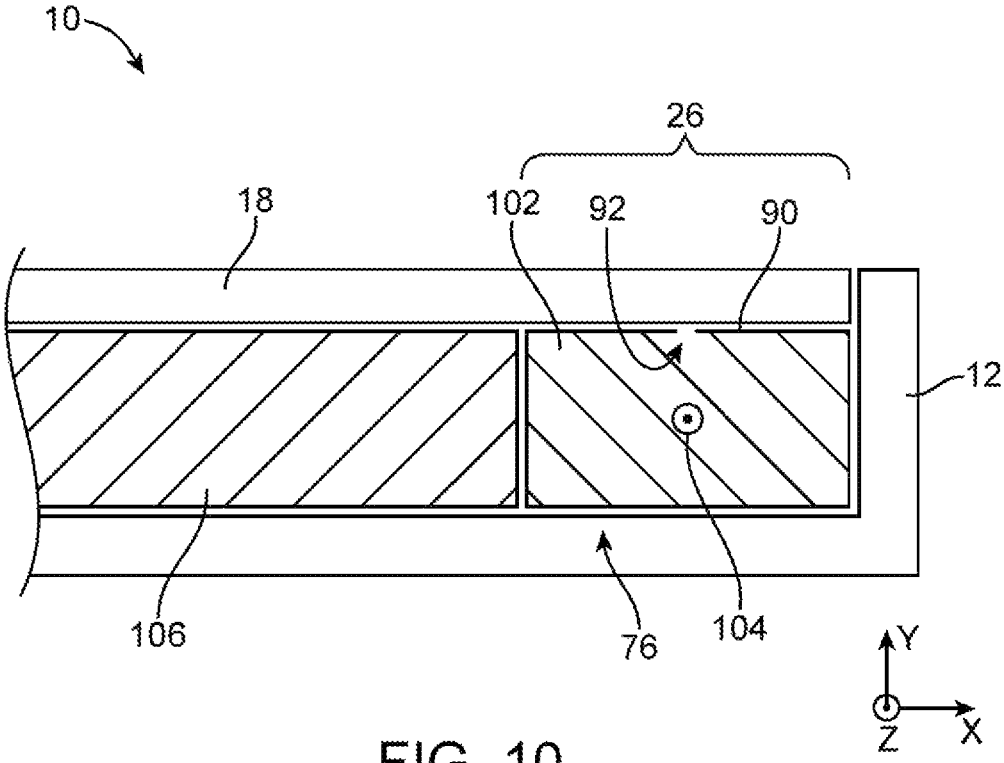
FIG. 10 is a cross-sectional end view of an illustrative loop-based antenna isolation element in an electronic device in accordance with an embodiment of the present invention.

A cross-sectional end view of an illustrative antenna isolation element 76 mounted within electronic device 10 is shown in FIG. 10. As shown in FIG. 10, antenna isolation element 76 may be mounted under a region such as region 26 (FIG. 1) between respective antennas 74 (not shown in FIG. 10). Antenna isolation element 76 may have a support structure such as support structure 102 with a rectangular cross-sectional shape to accommodate rectangular sidewalls and rear housing structures in housing 12 (as an example). Conductive structures 90 may form a loop that extends around longitudinal axis 104 of antenna isolation element 76. Gap 92 may be interposed in the path of the loop to form a capacitance, as described in connection with FIG. 8.

In the illustrative configuration of FIG. 10, the cross-sectional shape of support structure 102 and antenna isolation element 76 is rectangular. If desired, other cross-sectional shapes may be used for antenna isolation element 76. In general, antenna isolation element 76 may have any suitable cross-sectional shape that forms a loop of radio-frequency currents around axis 104 in response to the operation of antennas 74 in antenna array 72.

Figure 11:
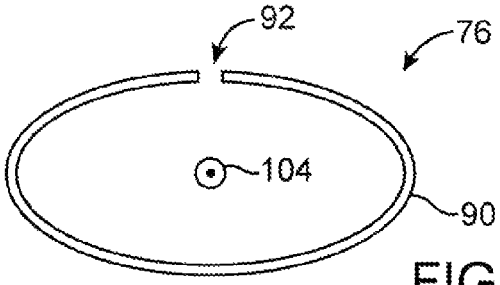
FIG. 11 is a cross-sectional end view of an illustrative loop-based antenna isolation element having an oval cross-sectional shape in accordance with an embodiment of the present invention.
Figure 12:
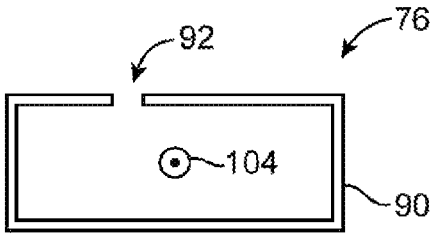
FIG. 12 is a cross-sectional end view of an illustrative loop-based antenna isolation element having a rectangular cross-sectional shape in accordance with an embodiment of the present invention.
Figure 13:
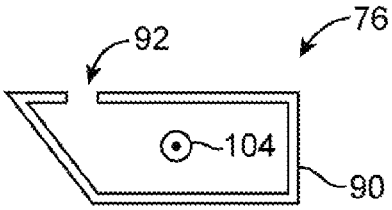
FIG. 13 is a cross-sectional end view of an illustrative loop-based antenna isolation element having a cross-sectional shape with an angled side in accordance with an embodiment of the present invention.
Figure 14:
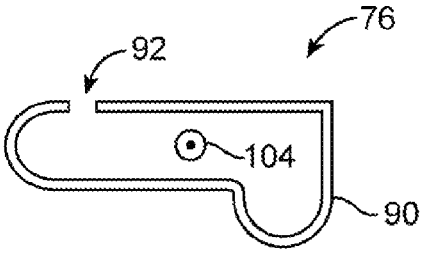
FIG. 14 is a cross-sectional end view of an illustrative loop-based antenna isolation element having a cross-sectional shape with a combination of straight and curved sides in accordance with an embodiment of the present invention.
Figure 15:
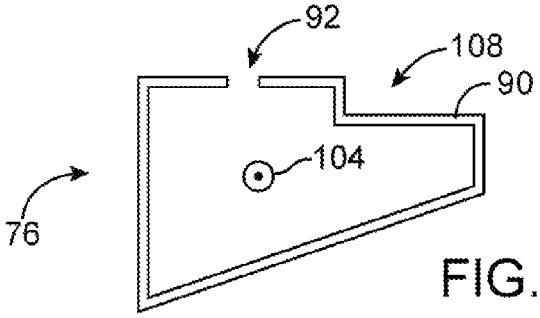
FIG. 15 is a cross-sectional end view of an illustrative loop-based antenna isolation element having a cross-sectional shape with straight edges that form a recessed portion in accordance with an embodiment of the present invention.

As shown in FIG. 11, for example, conductive layer 90 may have an oval cross-sectional shape when viewed along longitudinal axis 104. In the FIG. 12 example, conductive layer 90 of antenna isolation element 76 has a rectangular cross-sectional shape. In the example of FIG. 13, conductive layer 90 forms a rectangular cross-sectional shape for antenna isolation element 76 with an angled sidewall. In particular, the upper and lower surfaces of antenna isolation element 76 of FIG. 13 are parallel to each other and are perpendicular to the right surface of antenna isolation element 76. The left surface of antenna isolation element 76 in FIG. 13 is angled at a non-orthogonal angle with respect to the upper and lower surfaces and does not lie parallel to the right surface of antenna isolation element 76. If desired, some of the surfaces of antenna isolation element 76 may be planar and other surfaces of antenna isolation element 76 may be non-planar, so that the cross-sectional shape of antenna isolation element 76 when viewed along longitudinal axis 104 has a combination of straight and curved sides, as shown in FIG. 14. FIG. 15 shows how the shape of antenna isolation element 76 may have a recessed portion such as recessed portion 108. Recesses such as recessed portion 108 may be configured so that antenna isolation element 76 can accommodate protruding housing structures in housing 12, internal components in device 10, and other structures in device 10.

The examples of FIGS. 11, 12, 13, 14, and 15 are merely illustrative. In general, conductive structures 90 of antenna isolation element 76 may have any suitable shape that causes currents to flow around axis 104 during operation in antenna array 72.

Figure 16:
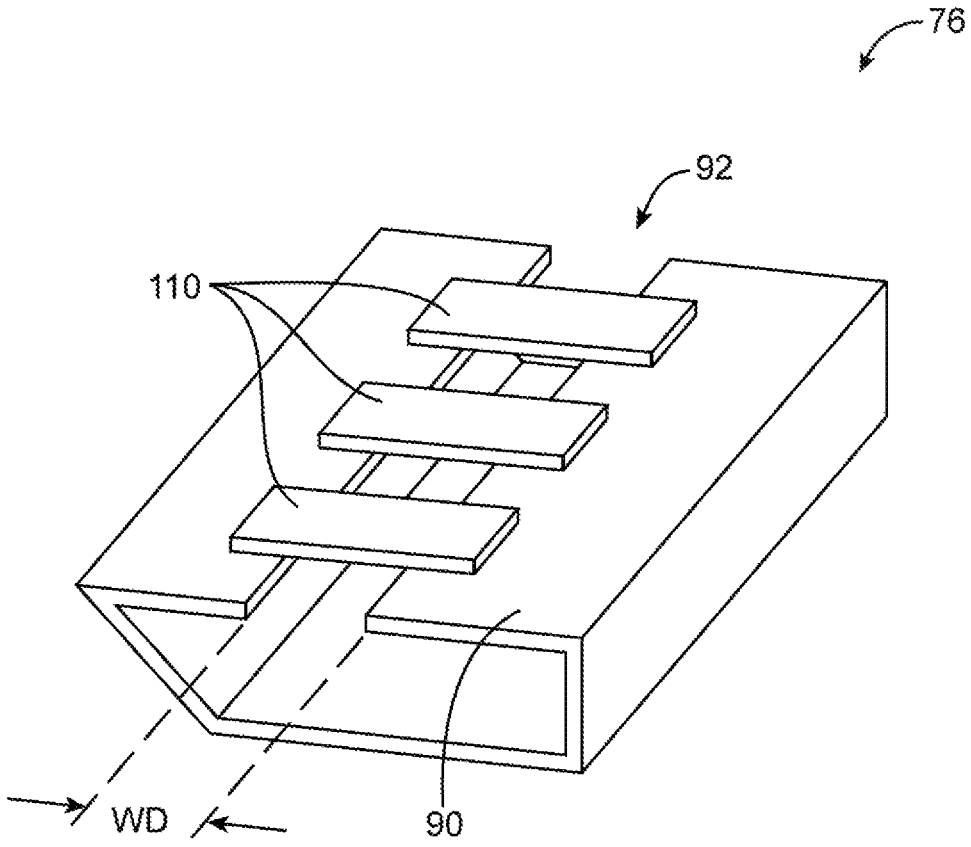
FIG. 16 is a perspective view of an illustrative loop-based antenna isolation element having electrical components that bridge a gap in a sheet of conductive material that forms the loop-based antenna isolation element in accordance with an embodiment of the present invention.

FIG. 16 shows how gap capacitance 92 in antenna isolation element 76 can be configured using electrical components 110. Gap 92 in conductive structures 90 may have a built-in capacitance due to its shape (i.e., whether meandering or straight) and size (e.g., gap width WD). In addition to the capacitance due to the layout of gap 92, the capacitance that is interposed within the loop formed by structures 90 may be affected by the capacitance of electrical components 110 that bridge gap 92. Electrical components 110 may be capacitors or components that exhibit a capacitance. Electrical components 110 may be, for example, surface mount technology (SMT) components that are attached to the conductive material of conductive structures 90 using solder. Electronic components 110 may include one or more integrated circuits, one or more components such as capacitors, resistors, inductors, etc. that are packaged within a common SMT package, radio-frequency filter components, or other suitable circuit components. If desired, antennas 74 may incorporate electronic components such as components 110 (e.g., components that bridge gap 50 of conductive structures 52 in loop structure L2 of antenna 74 of FIG. 5).

Components such as one or more of electronic components 110 or other components associated with one or more antenna isolation elements 76 and/or antennas 74 in antenna array 72 may be implemented using tunable components. Tunable components may be controlled in real time using control circuitry in device 10 such as control circuitry 82 of FIG. 4 (e.g., to produce desired amounts of capacitance). This allows device 10 to tune the frequency response of antennas 74 and/or antenna isolation elements 76 and therefore allows device 10 to tune the overall performance of antenna array 72. Device 10 may, for example, tune antennas 74 and/or antenna isolation elements 76 when it is desired to cover a particular frequency band or bands of interest (e.g., when switching from one type of wireless communications mode to another, when device 10 is moved into a new geographical region that uses a different set of wireless communications frequencies, etc.).

Figure 17:
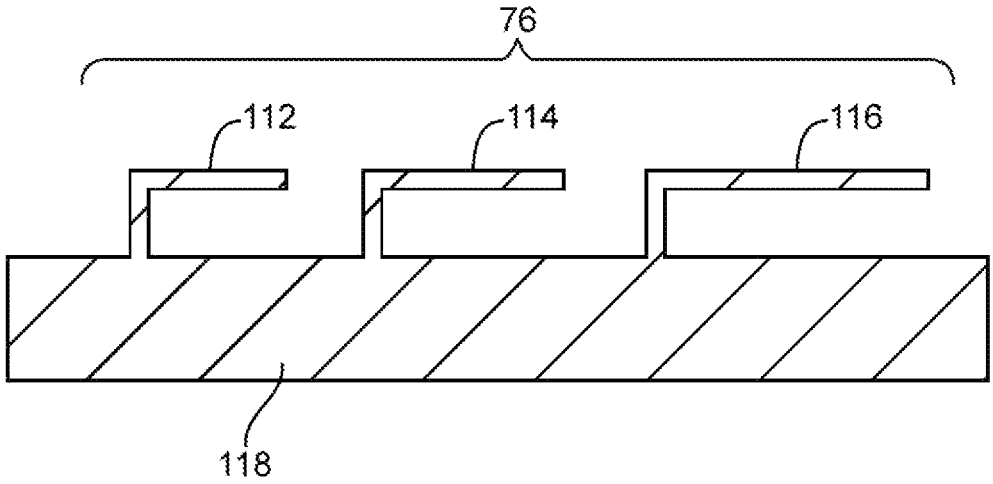
FIG. 17 is a diagram of an illustrative antenna isolation element formed from multiple L-shaped parasitic elements in accordance with an embodiment of the present invention.

FIG. 17 shows how antenna isolation element 76 may be implemented using L-shaped parasitic elements extending from a common ground plane structure such as ground conductor 118. As shown in FIG. 17, antenna isolation element 76 may include two or more L-shaped conductive elements such as L-shaped parasitic element 112, L-shaped parasitic element 114, and L-shaped parasitic element 116. Each L-shaped element in antenna isolation element 76 may have a different length so that each L-shaped parasitic element contributes a resonance peak (and a corresponding antenna isolation contribution) at a different corresponding frequency. If desired, other types of conductive structures may be used in forming a parasitic antenna element (e.g., structures with more than one conductive branch such as T-shaped structures, structures formed from strips of conductive material that form planar L-shaped elements, structures with other shapes, etc.). The example of FIG. 17 is merely illustrative.

Figure 18:
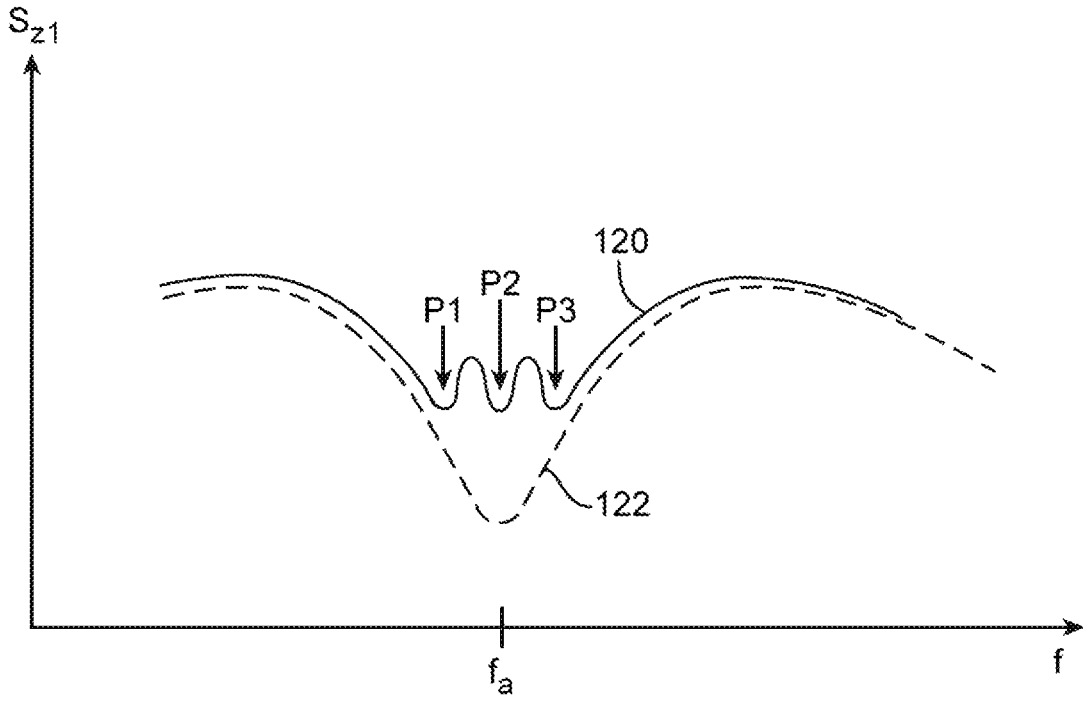
FIG. 18 is a graph comparing how coupling between a pair of antennas may be reduced using different types of antenna isolation elements in accordance with embodiments of the present invention.

FIG. 18 is a graph comparing antenna isolation performance for an antenna isolation element of the type shown in FIG. 17 (curve 120) and an antenna isolation element of the type shown in FIG. 9 (curve 122). In the configuration shown in FIG. 17, antenna isolation element 76 has three individual L-shaped resonating structures that resonate in response to radio-frequency signals from antennas 74 in array 72. The presences of the three separate L-shaped elements in antenna isolation element 76 of FIG. 17 gives rise to three corresponding decreases in coupling (S21) between a pair of antennas 74 in array 72 (shown as isolation resonances P1, P2, and P3). Each resonance P1, P2, and P3 is associated with a different frequency f, because each of elements 112, 114, and 116 in antenna isolation element 76 of FIG. 17 has a different corresponding length and therefore a different resonance behavior. Collectively, resonances P1, P2, and P3 may serve to isolate a pair of antennas 74 in array 72 in a communications band centered at operating frequency fa.

Curve 122 of FIG. 18 corresponds to an isolation element of the type shown in FIG. 9 in which conductive loop structures 90 have a dimension L along longitudinal axis 104. The size of L (e.g., 1-10 cm), helps to broaden the bandwidth of isolation element 76, so that curve 122 (in the FIG. 18 example) is broader and deeper than curve 120. In general, increases in dimension L of antenna isolation element 76 may be used to increase the amount of isolation (isolation bandwidth) exhibited by antenna isolation element 76.

When using an isolation element of the type shown in FIG. 9, common ground currents from antennas in the antenna array (i.e., induced currents flowing along dimension Z) tend to be drawn into current path 98 (FIG. 9) in the isolation element and do not couple significantly further along the array. The configuration of loop-based isolation element 76 of FIG. 9 may therefore help suppress antenna-to-antenna coupling through shared ground currents.

Elements 112, 114, and 116 of isolation element 76 in FIG. 17 serve as parasitic elements that tend to create virtual open circuits to the common ground currents traveling along the Z axis that lower coupling between antennas in the array that share common ground plane 118.

Figure 19:
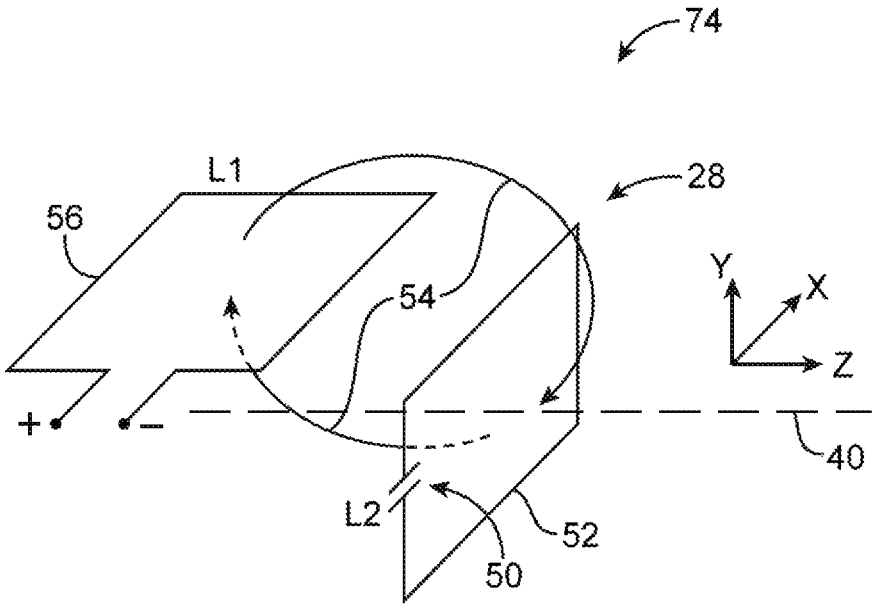
FIG. 19 is a diagram showing how an antenna may have a first loop antenna structure for indirectly feeding a second loop antenna structure and showing how the structures of the antenna may be oriented relative to an X-Y-Z coordinate system in accordance with an embodiment of the present invention.

FIG. 19 is a diagram showing how antenna feed structure L1 may be used to indirectly feed antenna resonating element L2 in an antenna of the type described in connection with antenna 74 of FIG. 5. The antenna feed structure for antenna 74 of FIG. 19 is formed from a directly fed loop antenna structure (antenna structure L1) and the antenna resonating element structure is formed from a loop antenna structure (e.g., antenna structure L2 of FIG. 5). Directly fed loop antenna structure L1 may include a loop of conductive material 56 that is directly fed by transmission line 80. The positive conductor in transmission line 80 may be connected to positive antenna feed terminal (+) and the ground conductor in transmission line 80 may be connected to ground antenna feed terminal (−). Loop antenna L2 may be formed using conductive structures such as conductive structures 52 that are distributed along the length of longitudinal axis 40. To avoid over-complicating the drawings, the distributed shape of conductive structures 52 in antenna resonating element L2 is not depicted in FIG. 19. Electromagnetic fields that may be coupled between structures L1 and L2 during operation of antenna 74 are represented by lines 54. In configurations of the type shown in FIG. 19, the plane that contains antenna feed structure L1 lies perpendicular to the plane that contains antenna resonating element structure L2. Other relative orientations between structures L1 and L2 may be used if desired.

Figure 20:
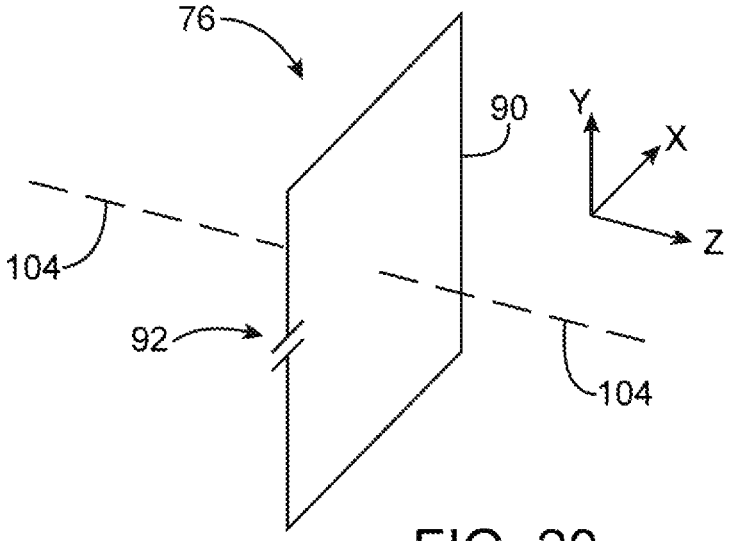
FIG. 20 is a diagram showing how an antenna isolation element may be oriented relative to an X-Y-Z coordinate system in accordance with an embodiment of the present invention.

In antenna 74 of FIG. 19, loop L2 lies in the X-Y plane and longitudinal axis 40 of antenna resonating element L2 is parallel to the Z axis. FIG. 20 is a diagram showing how antenna isolation element 76 may be oriented so that loop-shaped path 90 lies in the X-Y plane and so that longitudinal axis 104 extends parallel to the Z-axis.

Figure 21:
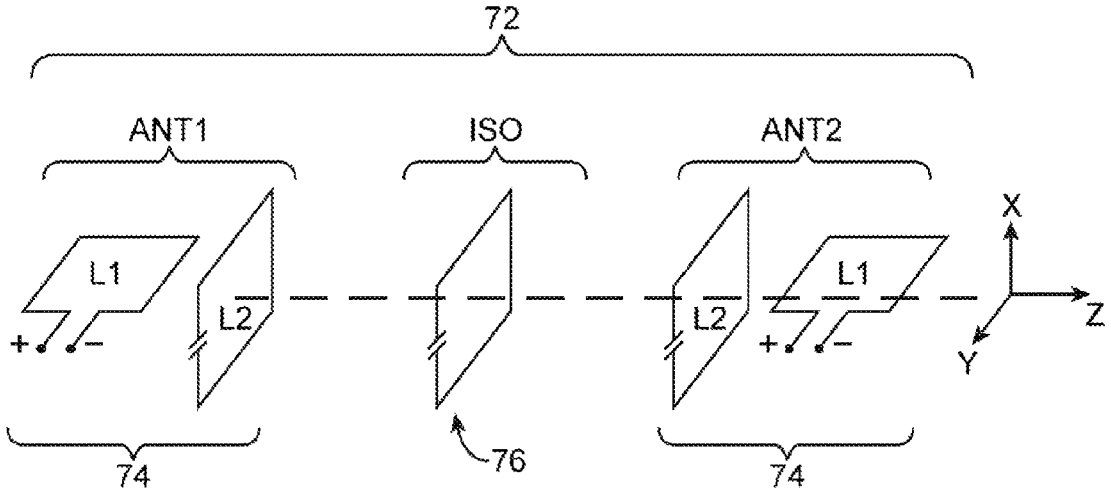
FIG. 21 is a diagram showing how an array of antennas and an interposed antenna isolation element may be oriented relative to one another to enhance antenna isolation in accordance with an embodiment of the present invention.

Antenna isolation may be enhanced by aligning antenna structures such as antenna structure 74 of FIG. 19 and antenna isolation elements such as antenna isolation element 20 so that longitudinal axis 40 of each antenna 74 lies along a common axis (i.e., the Z-axis) with longitudinal axis 104 of antenna isolation element 76, as shown in the example of FIG. 21. In the FIG. 21 example, antennas ANT1 and ANT2 are being isolated using interposed antenna isolation element ISO, each of which is aligned along a common axis (axis Z).

In this configuration, currents in each antenna 74 travel along the conductive path of loop L2 rather than towards an adjacent antenna, which minimizes the amount of current that is induced in one of antennas 74 when operating another of antennas 74 through common ground plane currents. The Z-axis tends to be associated with a null in the radiation pattern for antennas 74 of the type shown in FIG. 19, so aligning each axis 40 along a common axis also may enhance isolation by reducing electromagnetic near-field coupling.

The antennas and antenna isolation elements of antenna array 72 of FIG. 21 may, if desired, be mounted within device 10 in a region such as one of regions 26 of FIG. 1. Other suitable antenna arrays may be formed if desired (e.g., to place multiple antennas within the hinge of a laptop computer, to place multiple antennas along the edge of a tablet computer or other portable device, etc.). In configurations such as these in which antennas are mounted along a common ground plane structure (e.g., shared traces on a printed circuit board, shared conductive electronic device housing structures 12, or other common ground plane structures), there is a potential for the antennas to couple through shared ground plane currents. When one or more or two or more antennas in an antenna array are formed using loop-antenna structures, antenna coupling through shared ground plane currents can be reduced by orienting the antenna resonating element loops perpendicular to the dimension along which common ground plane currents have the potential to flow.

In the antenna array of FIG. 21, for example, loop currents in loop antenna resonating elements L2 flow in the X-Y plane, perpendicular to dimension Z. Common ground plane currents associated with antenna-to-antenna coupling would flow in dimension Z, past each antenna in the array. When using loop antennas, however, currents in the loop antenna resonating elements flow in the X-Y plane, not along dimension Z. Common ground currents between antennas (i.e., shared ground plane currents along dimension Z) are therefore suppressed when the loop antenna resonating elements are configured so that loop currents flow in the X-Y plane, providing additional isolation to that provided by the antenna isolation element.

The foregoing is merely illustrative of the principles of this invention and various modifications can be made by those skilled in the art without departing from the scope and spirit of the invention.

What is claimed is:

1. An antenna array, comprising:

at least first and second antennas; and an antenna isolation element formed from a loop of conductor that is configured to isolate the first and second antennas from each other, wherein the antenna isolation element is formed from a sheet of conductive material that extends around an axis to form the loop of conductor, wherein the loop of conductor has a gap, wherein the sheet of conductive material has a first dimension that spans the sheet of conductive material parallel to the axis and has a second dimension associated with a peripheral length of the sheet of conductive material around the axis, and wherein the first dimension is 1-10 cm and the second dimension is 1.5 to 3.5 cm.

2. The antenna array defined in claim 1 wherein the antenna isolation element is interposed between the first and second antennas.

3. The antenna array defined in claim 2 wherein the antenna isolation element comprises a dielectric carrier and wherein the sheet of conductive material comprises metal on the dielectric carrier.

4. The antenna array defined in claim 3 wherein the gap spans the sheet of conductive material.

5. The antenna array defined in claim 4 wherein the gap is configured to form a meandering path across the sheet of conductive material.

6. The antenna array defined in claim 5 wherein the first and second antennas comprise loop antennas.

7. The antenna array defined in claim 6 wherein the first and second antennas each have a sheet of conductive material configured to form a loop antenna resonating element.

8. The antenna array defined in claim 4 wherein the first and second antennas each comprise a loop-shaped antenna resonating element and a loop-shaped antenna feed structure, wherein the loop-shaped antenna feed structure in the first antenna indirectly feeds the loop antenna resonating element in the first antenna, and wherein the loop-shaped antenna feed structure in the second antenna indirectly feeds the loop antenna resonating element in the second antenna.

9. The antenna array defined in claim 1 wherein the first and second antennas comprise distributed loop antennas.

10. The antenna array defined in claim 9 wherein the first and second antennas comprise strips of conductive material that each extend around the axis and that are each configured to form a respective loop with a gap.

11. An electronic device, comprising:

a housing;

a display in the housing; and an antenna array mounted in the housing along an edge of the display, wherein the antenna array includes at least first and second antennas and an antenna isolation element formed from a loop of conductor with a gap and wherein the loop of conductor is configured to isolate the first and second antennas from each other.

12. The electronic device defined in claim 11 wherein the antenna isolation element is interposed between the first and second antennas and comprises a sheet of conductive material that extends around an axis to form the loop of conductor with the gap.

13. The electronic device defined in claim 12 wherein the sheet of material has a dimension that spans the sheet of material parallel to the axis and wherein the first and second antennas are located along the axis.

14. The electronic device defined in claim 13 further comprising at least one electrical component that bridges the gap.

15. The electronic device defined in claim 14 further comprising control circuitry that supplies control signals that adjust the electrical component to tune the antenna isolation element.

16. An antenna isolation element configured to isolate first and second antennas in an electronic device from each other, comprising:

a dielectric carrier; and conductive material on the dielectric carrier that forms a loop, wherein the conductive material comprises a sheet of conductive material that extends around the dielectric carrier and that has a gap, wherein the dielectric carrier has a longitudinal axis, wherein the sheet of conductive material has a first dimension that spans the sheet of conductive material parallel to the longitudinal axis and has a second dimension associated with a periphery of the sheet around the longitudinal axis, and wherein the first dimension is 1-10 cm and the second dimension is 1.5 to 3.5 cm.

* * * * *